United States Patent [19]

Rodenbaugh

[11] 4,025,153

[45] May 24, 1977

[54] ELECTRICAL CONNECTOR FOR CARPET SEAMING TAPE

[75] Inventor: Ralph Rodenbaugh, Pittsburgh, Pa.

[73] Assignee: Deco Coatings Corporation, Pittsburgh, Pa.

[22] Filed: Feb. 11, 1976

[21] Appl. No.: 657,251

[52] U.S. Cl. ..... 339/255 R; 219/142

[51] Int. Cl.[2] ..... H01R 11/22

[58] Field of Search ..... 339/255 R, 255 L, 108 TP; 219/140, 141, 142

[56] References Cited

UNITED STATES PATENTS

| | | | |
|---|---|---|---|
| 1,833,835 | 11/1931 | Hieronymus | 339/255 L X |
| 2,395,214 | 2/1946 | Bourque | 219/142 |
| 2,609,471 | 9/1952 | Bergeson | 219/142 |
| 2,769,155 | 10/1956 | Wimble | 339/108 TP |

*Primary Examiner*—J. Howard Flint, Jr.

*Attorney, Agent, or Firm*—Brown, Murray, Flick & Peckham

[57] ABSTRACT

A connector apparatus to couple an electrical cable of a low-voltage power supply to an electrically-resistive heater strip carrying a layer of thermoplastic adhesive. The connector includes an elongated housing having a projecting support leg and a clamp jaw at opposite ends of the housing to support the housing so as to extend in a downwardly-inclined manner. The walls of the housing form an open cavity which is adapted to receive a helical spring through which a cable extends from an end wall of the housing to a connector used to secure the end of the cable to a bus bar. The bus bar is guided for movement along the length of the housing. The bus bar is urged by the spring toward the clamp jaw to grip the edge of the electrically-resistive heater strip used to heat in situ the thermoplastic adhesive that forms carpet seaming tape.

8 Claims, 3 Drawing Figures

ELECTRICAL CONNECTOR FOR CARPET SEAMING TAPE

BACKGROUND OF THE INVENTION

This invention relates to a connector apparatus to couple an electrical cable of a power supply to an electrically-resistive heater strip and more particularly to such a connector apparatus to facilitate the seaming together of abutting edges of carpeting by using carpet seaming tape that includes a heater strip which is releasably connected to the low-voltage power supply for heating a layer of thermoplastic adhesive in situ along marginal edges at the back surface of the carpeting.

In my copending application Ser. No. 620,557, there is disclosed a method and apparatus including tape with thermoplastic adhesive for installing carpeting and the like. The method and apparatus include the use of a low-voltage power supply that is connected at spaced-apart locations by cables to a metallic strip employed to generate a sufficient quantity of heat which will conductively heat a layer of hot-melt adhesive to a desired elevated temperature incident to the formation of a bonded connection with the marginal edges at the back surface along the abutting edges of carpeting and the like. The actual bonding operation is carried out while the carpet seaming tape is in situ whereby the back surfaces of abutting edges of carpeting contact the layer of adhesive carried by the metallic strip. The carpet tape disclosed in this application is also adapted for adhering the peripheral edge of carpeting to a floor surface with or without the employment of a nail strip.

This method and apparatus for seaming abutting edges of two pieces of carpeting together enables the formation of a bonded connection having high integrity as well as flexibility to assure the proper abutted positioning of the carpet. By using the electrically-resistive properties of the metal strip carrying the thermoplastic adhesive, it is possible to reheat the adhesive to adjust the position of the abutted edges of carpeting as well as to release the bonded connection formed by the tape.

SUMMARY OF THE INVENTION

It is an object of the present invention to provide a connector apparatus to couple a cable of a power supply to an electrically-resistive heater strip carrying a layer of thermoplastic adhesive employed to form a bonded connection with carpeting and the like.

It is a further object of the present invention to provide a connector apparatus which is constructed and arranged to facilitate rapid connection and disconnection with an electrically-resistive heater strip while holding the strip in situ upon a support surface.

It is still another object of the present invention to provide a connector apparatus to couple an electrical cable of a low-voltage power supply to an electrically-resistive heater strip carrying a layer of thermoplastic adhesive while extending along the marginal edges of abutting pieces of carpeting by constructing the connector apparatus to project beneath one piece of carpeting while supported in an overlying relation upon the other piece of carpeting with a minimum of disturbance to the desired abutting relation between the carpet pieces.

It is still another object of the present invention to provide a connector apparatus to couple an electrical cable of a power supply to an electrically-resistive heater strip carrying a layer of thermoplastic adhesive by constructing the connector apparatus to project in a downwardly-inclined manner in a spaced and transversing relation above the layer of thermoplastic adhesive so as to avoid contact with the adhesive during the heating process.

According to the present invention, there is provided a connector apparatus to couple an electrical cable of a low-voltage and high-current power supply to an electrically-resistive heater strip carrying a layer of thermoplastic adhesive, the apparatus including the combination of an elongated connector housing having a housing support surface and a clamp jaw at opposite ends thereof, a bus bar carried by the housing for moving toward and away from the clamp jaw to releasably engage the heater strip, resilient means supported by the housing for urging the bus bar toward the clamp jaw, and means to couple the bus bar to the cable.

In the preferred form of the present invention, the connector housing includes an outwardly-projecting support leg to position the housing in a downwardly-inclined manner so that the housing extends in a closely-spaced relation above the heater strip while engaged between the clamp jaw and the bus bar. The cable from the power supply extends through an end wall in the housing where it is surrounded by a helical spring engaged at one end with the housing wall and urging a connector receiving the cable toward the clamp jaw at the other end of the housing. It is preferred to construct the bus bar with a T-shape configuration and provide guide means on the housing for a centrally-projecting tongue of the bus bar.

These features and advantages of the present invention as well as others will be more readily understood when the following description is read in light of the accompanying drawings, in which.

Figure 1:
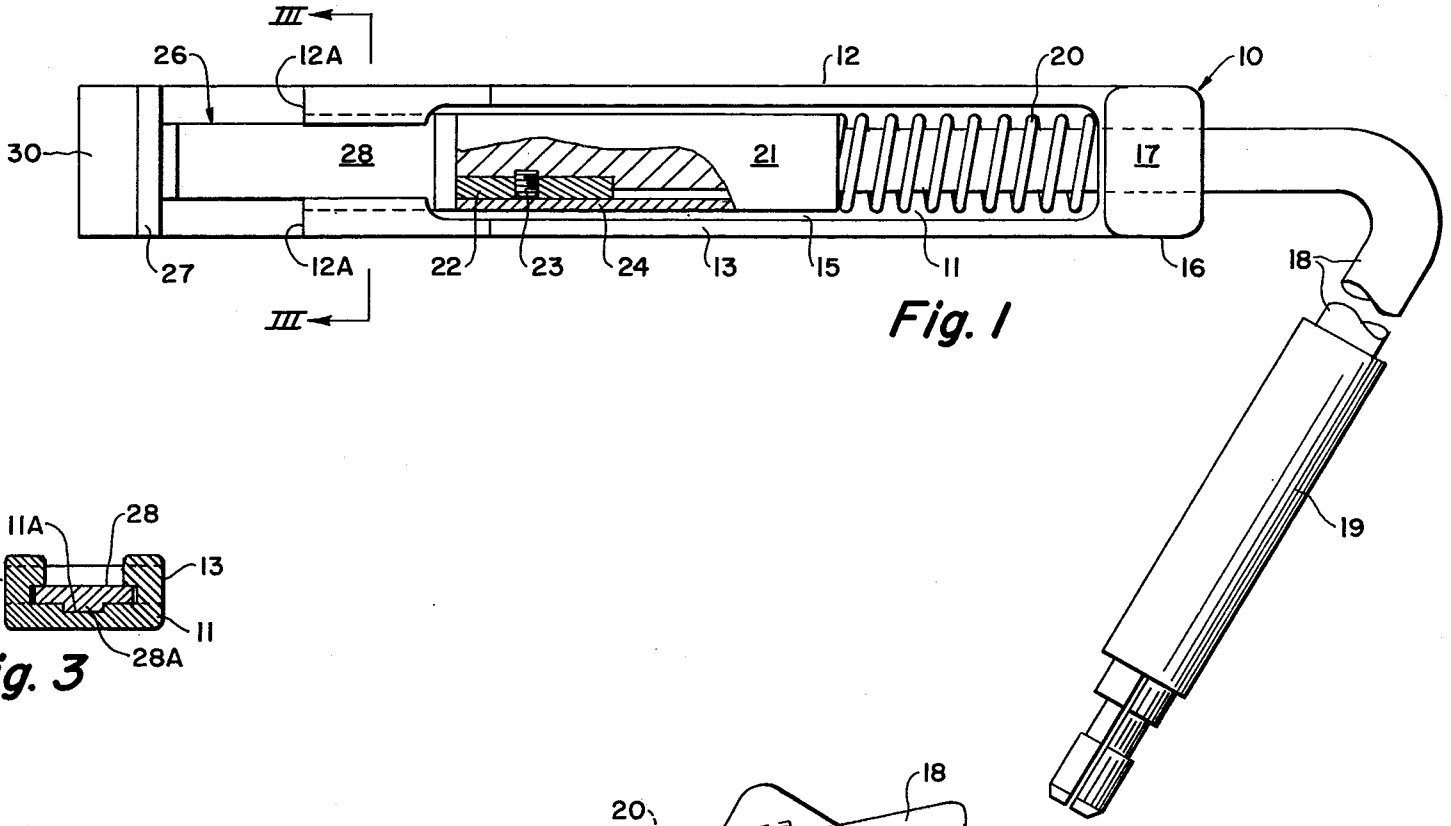
FIG. 1 is a bottom view of the clamp apparatus embodying the features of the present invention.
Figure 2:
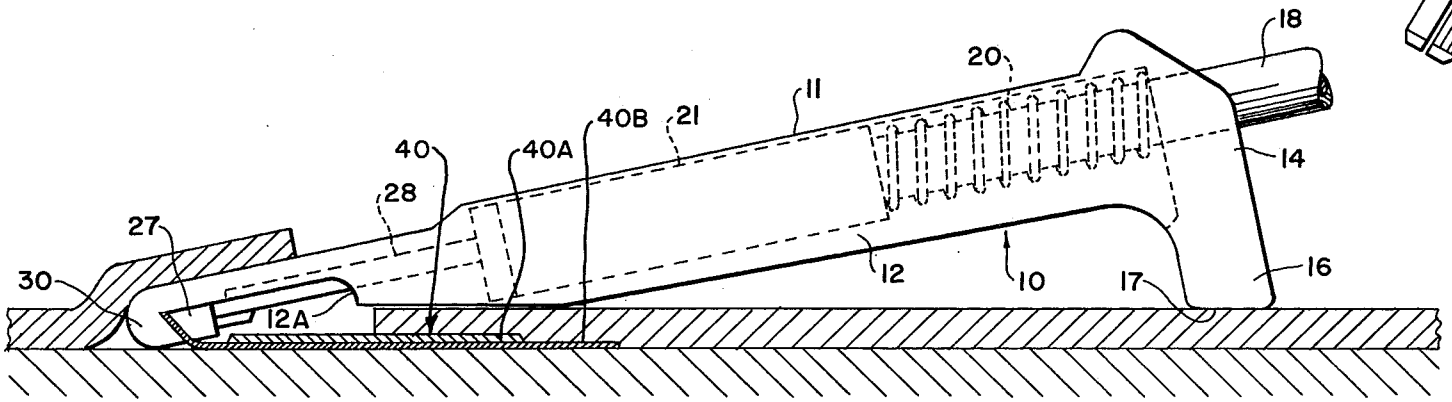
FIG. 2 is an elevational view of the clamp apparatus shown in FIG. 1 cooperatively engaged with carpet seaming tape.
Figure 3:
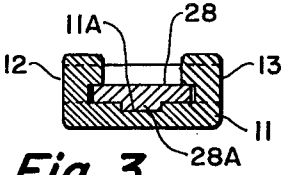
FIG. 3 is a sectional view taken along line III—III of FIG. 1.

As shown in FIGS. 1 and 2, the clamp apparatus of the present invention includes an elongated connector housing 10 formed by a back wall 11 with integral and spaced-apart side walls 12 and 13. An end wall 14 closes one end of a housing cavity 15 lying between the side walls 12 and 13. The end wall 14 extends downwardly and projects from the housing to form part of a support leg 16. A flat support surface 17 is formed on the projected end of the support leg 16. The end wall 14 includes an annular opening adapted to receive a cable 18 having a plug-type connector 19 secured to its one end for connection to a low-voltage, high-current power supply. For example, the power supply and cable 18 conduct 12-volt alternating current at a current up to 200 amperes.

A resilient member in the form of a helical coil spring 20 has one end supported by the end wall 14 and surrounds the cable 18 within the housing cavity. The other end of spring 20 contacts a connector assembly 21 which includes a sleeve coupling member 22 into which the bared-wire end of the cable is received. A set screw 23 or an equivalent form of locking device secures the bare end of the cable to the sleeve. The sleeve is, in turn, surrounded by an insulating tube 24 which forms part of the connector 21. The sleeve 22 is welded or otherwise secured to a bus bar 26. The bus bar is preferably an integral element having a T-shaped configuration defined by a bus bar head 27 and a centrally extending tongue 28. The bus bar extends from the housing cavity beyond terminal ends 12A of the side walls 12 toward a reversely-bent clamp jaw section 30 that projects from the back wall 11 of the housing. The terminal ends 12A form lateral openings to the housing cavity up to the clamp jaw section 30. The bus bar head is slidably moved under the spring force developed by spring 20 toward and into engagement with the clamp jaw. To facilitate this movement of the bus bar, the side walls 12 of the housing include projections that overlie the bus bar to form guides at the opposite sides thereof. Further guiding of the bus bar is provided by a projection 28A extending from the back wall of the bus bar into a recess 11A formed in the back wall 11.

In light of the foregoing description and as shown in FIG. 2, it is clearly apparent that the connector housing is adapted for support at its opposite ends by the support surface 17 and clamp jaw 30 to extend in a downwardly-inclined relation. The clamp apparatus of the present invention is employed to couple the electrical cable 18 of a power supply to carpet seaming tape 40 after a selected length of the tape is positioned to extend along a floor surface and the terminal edges of two pieces of carpeting to be seamed together are abutted. The carpet seaming tape 40 essentially includes a layer of hot-melt, thermoplastic adhesive 40A that is spaced inwardly to expose marginal edges of a metal strip 40B, preferably in the form of an aluminum strip that is typically 0.006 inch in thickness. A reinforcing scrim is preferably embedded within the layer of thermoplastic adhesive. The carpet seaming tape is orientated so that the layer of thermoplastic adhesive extends along the marginal edge at the back surface of abutting edges of the carpet. The clamp jaw 30 of the connector apparatus is inserted beneath one piece of carpeting while the clamp overlies the other and supported thereon by the leg 16. The clamp jaw is inserted beneath the displaced piece of carpeting beyond the side edge of the metal strip which forms the electrically-resistive heater strip. A force is then established between the cable 18 and the housing 10 whereby the spring 20 is compressed and the bus bar is spaced from the clamp jaw. The connector housing is then moved in the direction to withdraw the clamp jaw from the seamline so that the exposed edge of the metal strip 40B passes into the airgap which is formed between the clamp jaw and the bus bar. After this occurs, the force established between the cable 18 and the housing is relaxed whereby the force of spring 20 is employed to grip the metal strip between the bus bar and the clamp jaw. Two clamp apparatus are brought into contact with the carpet seaming tape at spaced-apart locations so that an electric current is passed along the carpet seaming tape to produce the desired heating. After the thermoplastic adhesive has been heated to the desired temperature, the connector apparatus of the present invention is disconnected from the seaming tape by moving the cable 18 relative to the housing to release the gripping force established between the clamp jaw and the bus bar by spring 20. After the clamp apparatus is removed from the position shown in FIG. 2, the displaced edge of carpeting is moved into its final desired relation. It will be understood, of course, that the displaced edge of carpeting is relatively short in relation to the length of the seamline formed between two pieces of carpeting.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. A connector apparatus to couple an electrical cable of a low-voltage and high-current power supply to an electrically-resistive heater strip carrying a layer of thermoplastic adhesive along one face surface of the strip, said apparatus including the combination of:

an elongated connector housing including a clamp jaw having a support surface for the housing at one end thereof and a projecting leg defining a support surface for the housing at the end thereof opposite to said clamp jaw, the support surfaces of said clamp jaw and said projecting leg being arranged at one side of the housing for support thereof at opposite sides of said heater strip while positioning said housing in an inclined manner to extend downwardly toward the support surface of said clamp jaw while passing in a spaced-apart relation above said layer of thermoplastic adhesive carried by said heater strip, a bus bar carried by said housing for movement toward and away from said clamp jaw to releasably engage said heater strip, resilient means supported by said housing for urging said bus bar toward said clamp jaw, and means to couple said bus bar to said cable.

2. The combination according to claim 1 wherein said elongated connector housing includes a back wall joined with spaced-apart side walls forming a housing cavity adapted to receive said bus bar and said resilient means.

3. The combination according to claim 2 wherein said elongated connector housing further includes an end wall having an annular opening therein adapted to pass said electrical cable into said housing cavity.

4. The combination according to claim 3 wherein said means to couple include a sleeve extending from said bus bar within said housing cavity, and fastening means for securing said cable to said sleeve.

5. The combination according to claim 4 wherein said resilient means includes helical coil spring surrounding said electrical cable within said housing cavity for extending between said end wall and said sleeve.

6. The combination according to claim 2 wherein said clamp jaw projects outwardly from said back wall at the side of said elongated connector housing containing said outwardly-projecting support leg, and wherein said side walls have terminal ends spaced from said clamp jaw to thereby form lateral openings to said housing cavity.

7. The combination according to claim 6 wherein said bus bar has a T-shaped configuration formed by a bus bar head and a centrally-projecting tongue secured to said means to couple.

8. The combination according to claim 1 further comprising means on said elongated connector housing for guiding said bus bar for sliding movement relative to said clamp jaw.

* * * * *